United States Patent [19]

Fukagai

[11] Patent Number: 4,946,766

[45] Date of Patent: Aug. 7, 1990

[54] ELECTROPHOTOGRAPHIC PHOTOCONDUCTOR HAVING INTERMEDIATE LAYER COMPRISING INDIUM OXIDE

[75] Inventor: Toshio Fukagai, Numazu, Japan

[73] Assignee: Ricoh Company, Ltd., Tokyo, Japan

[21] Appl. No.: 315,165

[22] Filed: Feb. 24, 1989

[30] Foreign Application Priority Data

Mar. 14, 1988 [JP] Japan ..... 63-61296

[51] Int. Cl.[5] ..... G03G 5/14

[52] U.S. Cl. ..... 430/60; 430/63; 430/65

[58] Field of Search ..... 430/60, 58, 69, 65, 430/63

[56] References Cited

U.S. PATENT DOCUMENTS 4,302,521 11/1981 Takei et al. ..... 430/58 X
4,352,876 10/1982 Suzuki ..... 430/58
4,416,963 11/1983 Takimoto ..... 430/69
4,446,217 5/1984 Takasu ..... 430/60 X
4,657,835 4/1987 Yashiki ..... 430/65 X

*Primary Examiner*—J. David Welsh
*Attorney, Agent, or Firm*—Oblon, Spivak, McClelland, Maier & Neustadt

[57] ABSTRACT

An electrophotographic photoconductor which comprises an electroconductive support; an undercoat layer formed thereon comprising (i) a reaction product between an active-hydrogen-containing compound having a plurality of active hydrogens and an isocyanate-group-containing compound, which reaction product serves as a binder resin, and (ii) finely-divided particles of indium oxide dispersed in the reaction product; and a photo-sensitive layer formed on the undercoat layer. The indium oxide may be partly replaced by metal oxide, metal fluoride, metal nitride, metal carbide or metal boride in an amount of not more than 50 wt. %.

27 Claims, No Drawings

ELECTROPHOTOGRAPHIC PHOTOCONDUCTOR HAVING INTERMEDIATE LAYER COMPRISING INDIUM OXIDE

BACKGROUND OF THE INVENTION

This invention relates to an improved electrophotographic photoconductor.

Recently, organic photoconductive materials, which are relatively inexpensive and cause no enviromental pollution, have been widely used as a photoconductor of electrophotographic copying machines.

As an organic electrophotographic photoconductor, there have been known photoconductive resin type photoconductors, typically a photoconductor comprising polyvinyl carbazole (PVK); charge-transport complex type photoconductors, typically a photoconductor comprising polyvinyl carbazole-2,4,7-trinitro-fluorenone (PVK-TNF); pigment-dispersed type photoconductors, typically a photoconductor in which phthalocyanine dispersed in a binder resin; and function-separated type photoconductors such as a photoconductor consisting essentially of a charge-generating material and a charge-transport material. Of these, the last one is currently attracting high attention.

When a high-photosensitive photoconductor of the function-separate type is applied to the Carlson process, it exhibits a low chargeability and a weak electric charge retention (large dark decay). Further, the chargeability and electric charge retention properties are drastically deteriorated in the course of repeated and continuous use, causing uneven image density and fogging. In addition, toner particles are unfavorably deposited on the background when reverse development is performed.

In general, the chargeability of the high-photosensitive photoconductor is reduced due to the preexposure fatigue. Such fatigue is chiefly caused by the light absorbed by the charge-generating material contained in the photoconductor. It is therefore considered that the longer the period in which the electric charges generated by the light absorption remain in a migrational state in the photoconductor and the greater the number of the generated electric charges, the greater the reduction in the chargeability of the photoconductor. Even if the photoconductor is electrically charged while the electric charges generated by light-absorption are in a residual state, the surface potential is not elevated until the residual electric charges are dissipated. This is because the electric charges at the surface of the photoconductor are neutralized with the residual carriers which migrate in the photoconductor. The rise of surface potential is thus delayed corresponding to the pre-exposure fatigue, so that the apparent surface potential is lowered.

In an attempt to overcome the above shortcomings in the prior art, the following intermediate layers have been proposed: intermediate layers of a cellulose nitrate resin type as disclosed in Japanese Laid-open Patent Application No. 47-6341, 48-3544 and 48-12034; intermediate layers of a nylon resin type as disclosed in Japanese Laid-open Patent Application Nos. 48-47344, 52-25638, 58-30757, 58-63945, 58-95351, 58-98739 and 60-66258; intermediate layers of a maleic acid resin type as disclosed in Japanese Laid-open Patent Application Nos. 49-69332 and 52-10138; and an intermediate layer of a polyvinyl alcohol resin as disclosed in Japanese Laid-open Patent Application No. 58-105155.

In addition, for the purpose of controlling the electric resistance of conventional intermediate layers, intermediate layers incorporated with various electroconductive additives have been proposed. Examples of such intermediate layers include an intermediate layer made of setting-resins in which carbon or a chalcogen material is dispersed as disclosed in Japanese Laid-open Patent Application No. 51-65942; an intermediate layer made of a compound which is thermally polymerized by using an isocyanate hardening agent together with a quaternary ammonium salt as disclosed in Japanese Laid-open Patent Application No. 52-82238; an intermediate layer containing a resistance-controlling agent as disclosed in Japanese Laid-open Patent Application No. 55-1180451; an intermediate layer made of resin in which aluminum oxide or tin oxide is dispersed as disclosed in Japanese Laid-open Patent Application No. 58-58556; an intermediate layer made of resin which contains an organic metal compound as disclosed in Japanese Laid-open Patent Application No. 58-93062; intermediate layers made of resins in which electroconductive particles are dispersed as disclosed in Japanese Laid-open Patent Application No. Nos. 58-93063, 60-97363 and 60-111255; an intermediate layer made of resin in which magnetite is dispersed as disclosed in Japanese Laid-open Patent Application No. 59-17557; intermediate layers made of resins in which powders of both $TiO_2$ and $SnO_2$ are dispersed as disclosed in Japanese Laid-open Patent Application Nos. 59-84257, 59-93453 and 60-32054; and an intermediate layer in which indium oxide is dispersed as disclosed in Japanese Laid-open Patent Application No. 57-81269.

The above-mentioned intermediate layers, however, cannot provide sufficient effect on the prevention of the reduction in the chargeability caused by the repeated and continuous use of the photoconductors, the delay in the rise of the surface potential thereof, or the considerable change in the residual electric potential.

SUMMARY OF THE INVENTION

It is therefore an object of the present invention to provide an improved electrophotographic photoconductor which is higly sensitive, shows extremely small reduction in the chargeability caused by the pre-exposure fatigue, and brings about no delay in the rise of the charged potential and a minimized change in the residual electric potential even after the cycle of charging and exposing is repeated for an extended period of time.

The foregoing object of the invention can be attained by an electrophotographic photoconductor comprising an electroconductive support; an undercoat layer formed on the electroconductive support, comprising (i) a reaction product between an active-hydrogen-containing compound having a plurality of active hydrogens and an isocyanate-group-containing compound, which reaction product serves as a binder resin, and (ii) finely-divided particles of indium oxide dispersed in the reaction product; and a photosensitive layer formed on the undercoat layer.

DETAILED DESCRIPTION AND THE PREFERRED EMBODIMENTS

According to the present invention, as the finely-divided particles of indium oxide for in the undercoat layer, finely-divided particles of pure indium oxide is most preferably employed. However, indium oxide which comprises or is mixed-with any of the following compounds is also usable. An acceptable amount of such a compound is 50 wt. % or less, preferably 30 wt. % or less, of the total amount of the indium oxide and the compound when used in combination. Examples of the compounds include metal oxides such as titanium oxide, aluminum oxide, calcium oxide, magnesium oxide, tin oxide, zirconium oxide, silicon oxide, beryllium oxide, zinc oxide, and yttrium oxide; metal fluorides such as magnesium fluoride, calcium fluoride, and aluminum fluoride; metal nitrides such as boron nitride, aluminum nitride, and silicon nitride; metal carbides such as boron carbide, and silicon carbide; and metal borides such as calcium boride, and silicon boride.

As the binder resin for the undercoat layer of the present invention, a binder resin comprising as the main component a reaction product between an active-hydrogen-containing compound having a plurality of active hydrogens of —OH group, —$NH_2$ group, >NH group, —SH group, or —COOH group, and a compound having an isocyanate group (—N=C=O group) is employed.

Examples of the active-hydrogen-containing compound having a plurality of active hydrogens include polyvinyl acetal, phenoxy resin, polyamide, polyester, alkyd resin, polyalkylene glycol, acrylic coplymers containing active hydrogens such as a hydroxy ethylmethacrylate group, and vinylacetate copolymers containing vinyl alcohol groups.

Examples of the compound having an isocyanate group include monoisocyanate compounds represented by R—N=C=O, such as methyl isocyanate, ethyl isocyanate, propyl isocyanate, butyl isocyanate, phenyl isocyanate, tolyl isocyanate, naphtyl isocyanate, nitrophenyl isocyanate, and vinyl isocyanate; diisocyanate compounds represented by O=C=N—R—N=C=O, such as tolylene diisocyanate, hexamethylene diisocyanate, o-tolyldiisocyanate, diphenylmethane diisocyanate, naphtylene diisocyanate, and a dimer of tolylene diisocyanate; triisocyanate compounds such as triphenylmethane triisocyanate, tris-(p-phenylisocyanate), and thiophosphate; and multifunctional isocyanate compounds prepared by dehydration condensation among a plurality of diisocyanates and/or triisocyanates.

A reaction between the compound having the active hydrogens and the compound having the isocyanate group generally proceeds by application of heat. During the reaction, the reaction system is maintained at the temperatures in a range of from 30° C. to 250° C. In order to control the reaction, it is preferable to use a conventional catalyst, such as amine, 1,8-diaza-bicyclo[5,4,0]undecene-7 (DBU), and metal catalysts.

Examples of the above catalysts include tetramethylbutane diamine [TMBDA), 1,4-diazabicyclo[2,2,2] octane (DABCO), dibutyl tin dilaurate (DBTL), tin octoate, N-ethylmorpholine, triethylamine, N,N,N',N'-tetramethyl-1,3-butane diamine, cobalt naphthenate, stannous chloride, tin tetra-n-butylate, stannic chloride, tin trimethylhydroxide, tin dimethyldichloride, and phenyl salts of DBU.

Any amount of the finely-divided particles of indium oxide can be incorporated into the undercoat layer; but a preferable amount is 70 wt. % or more, and a more preferable amount is 80 to 90 wt. %, of the above resin binder when the photosensitivity and chargeability of the photoconductor are taken into consideration.

In order to obtain high sensitivity and to minimize the accumulation of the residual potential, it is preferable that the thickness of the undercoat layer be in the range of from 0.2 μm to 20 μm, more preferably in the range of from 0.5 μm to 5 μm.

The undercoat layer in the present invention may be formed in such a manner that a solution or a dispersion of the above-described components of the undercoat layer is applied to an electroconductive support, and then dried.

As the electroconductive support for use in the present invention an electroconductive material having a volume resistivity of $10^{10}$ Ωcm or less is usable. Examples of such materials include metals such as aluminum, nickel, chrome, nichrome, copper, silver, gold, and platinum; a sheet-shaped plastic film, a cylindrical plastic film or cylindrical paper coated with a metal oxide such as tin oxide and indium oxide by vacuum evaporation or sputtering; a sheet-shaped or cylindrical plastic film in which the above-mentioned metal or conductive carbon is dispersed; metal plates of aluminum, an aluminum alloy, nickel, and stainless steel; and drums thereof prepared in such a manner that the above metal plate is made into a drum by drawing and ironing, followed by a surface treatment thereof such as cutting, super-finishing, and abrasion.

As the photosensitive layer for use in the present invention, both single and multiple type photosensitive layers are usable. The single type photosensitive layer comprises a charge-generating material and a charge-transport material, and the multiple type photosensitive layer comprises a charge-generating layer containing a charge-generating material and a charge-transport layer containing a charge-transport material. Of these, the latter one, a so-called function-separated type photosensitive layer, is preferably employed in the present invention.

The charge-generating layer contained in the photosensitive layer comprises a charge-generating material as the main component, and a binder resin can be added to the layer, if necessary.

Examples of such binder resins include polyamide, polyurethane, polyester, epoxy resin, polyketone, polycarbonate, silicone resin, acrylic acid resin, polyvinyl butyral, polyvinyl formal, polyvinyl ketone, polystyrene, poly-N-vinylcarbazole, and polyacrylamide.

Examples of the charge-generating materials include C. I. Pigment Blue 25 (C. I. 21180), C. I. Pigment Red 41 (C. I. 21200), C. I. Acid Red 52 (C. I. 45100), C. I. Basic Red 3 (C. I. 45210), phthalocyanine pigments having a porphyrin skeleton, azulenium salt pigments, squaric salt pigments, an azo pigment having a carbazole skeleton as disclosed in Japanese Laid-open Patent Application No. 53-95033, azo pigments having a styrylstilbene skeleton as disclosed in Japanese Laid-open Patent Application No. 53-138229, azo pigments having a triphenylamine skeleton as disclosed in Japanese Laid-open Patent Application No. 53-132547, azo pigments having a dibenzothiophene skeleton as disclosed in Japanese Laid-open Patent Application No. 54-21728, azo pigments having an oxadiazole skeleton as disclosed in Japanese Laid-open Patent Application No. 54-12742, azo pigments having a fluorenone skeleton as disclosed in Japanese Laid-open Patent Application No. 54-22834, azo pigments having a bis-stilbene skeleton as disclosed in Japanese Laid-open Patent Application No. 54-17733, azo pigments having a distyryl oxadiazole skeleton as disclosed in Japanese Laid-open Patent Application No. 54-2129, azo pigments having a distyryl carbazole skeleton as disclosed in Japanese Laid-open Patent Application No. 54-17734, trizo pigments having a carbazole skeleton as disclosed in Japanese Laid-open Patent Application Nos. 57-195767 and 57-195768, phthalocyanine-type pigments such as C. I. Pigment Blue 16 (C. I.. 74100), indigo-type pigments such as C. I. Vat Brown 5 (C. I. 73410) and C. I. Vat Dye (C. I. 73030), and perylene-type pigments such as "Algo Scarlet B" (made by Violet Co., Ltd.) and "Indanthrene Scarlet R" (made by Bayer Ag.).

Of the above, the azo pigments are preferably used in the present invention, and the disazo and trisazo pigments are most preferably used in the present invention.

Specific examples of the azo pigments are as follows.

| Pigment No. | A |
|---|---|
| | 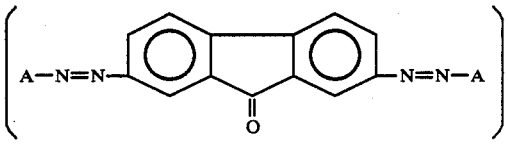 |
| 1 | 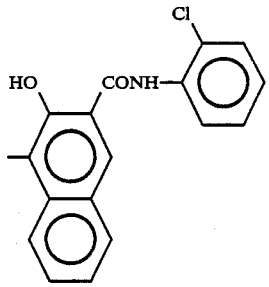 |
| 2 | 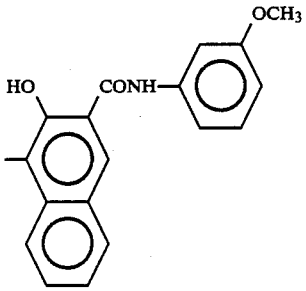 |
| 3 | 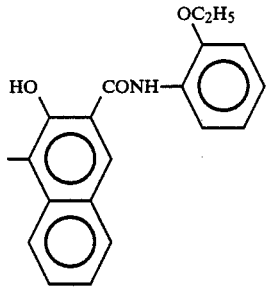 |
| 4 | 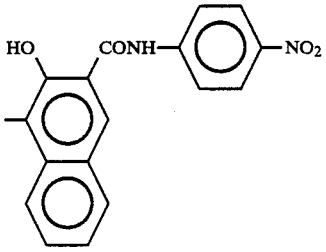 |

-continued
| Pigment No. | A |
|---|---|
| 5 | 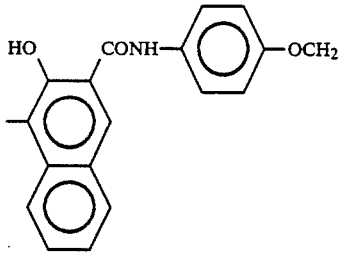 |
| 6 | 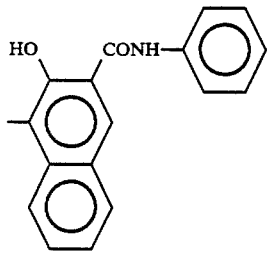 |
| 7 | 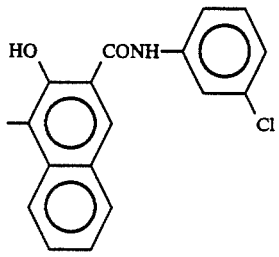 |
| 8 | 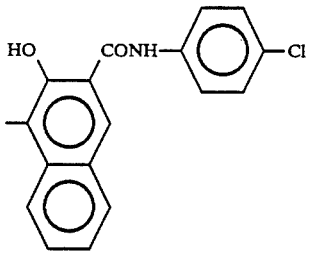 |
| 9 | 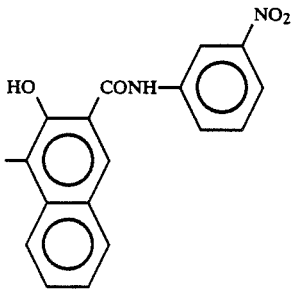 |

-continued
| Pigment No. | A |
|---|---|
| 10 | 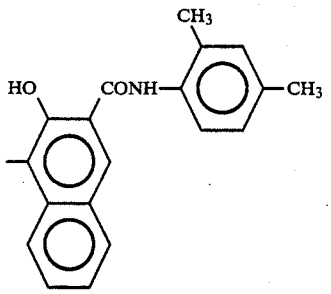 |
| 11 | 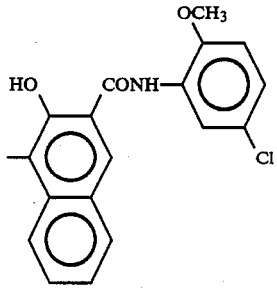 |
| 12 | 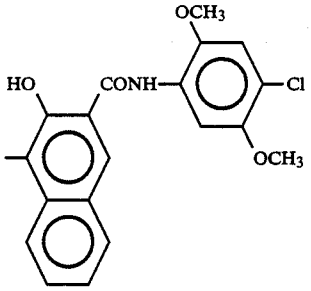 |
| 13 | 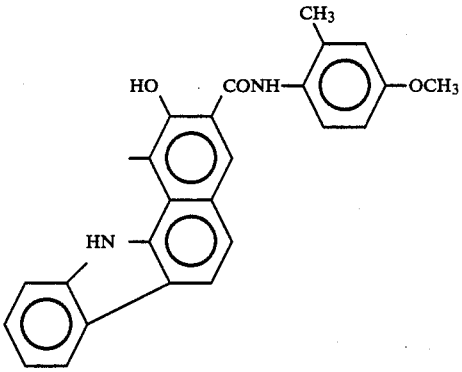 |
| 14 | 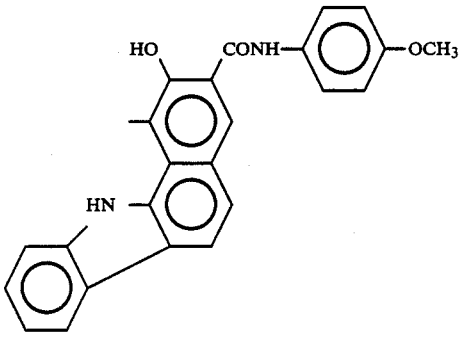 |

-continued
| Pigment No. | A |
|---|---|
| 15 | 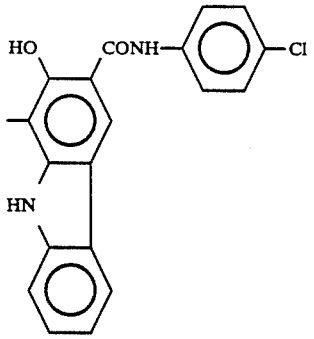 |
| 16 | 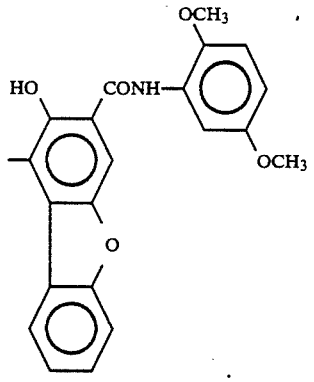 |
| 17 | 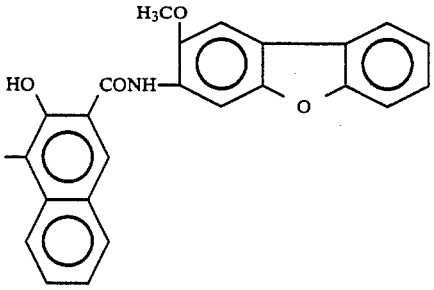 |
| 18 | 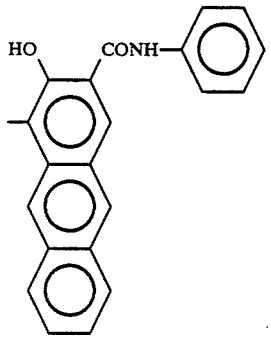 |

-continued
| Pigment No. | A |
|---|---|
| 19 | 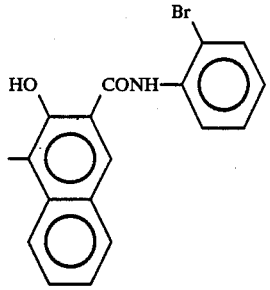 |
| 20 | 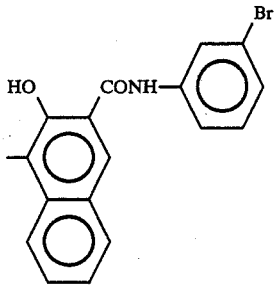 |
| 21 | 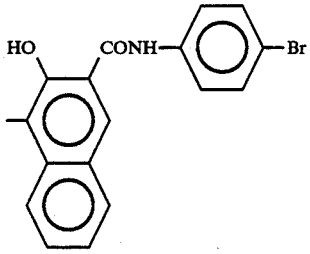 |
| | 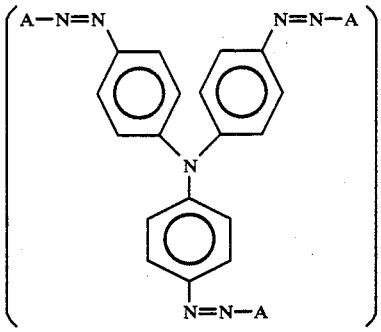 |
| 22 | 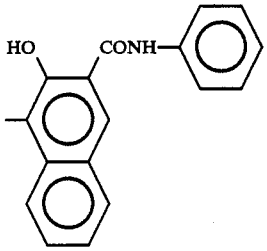 |

-continued
| Pigment No. | A |
|---|---|
| 23 | 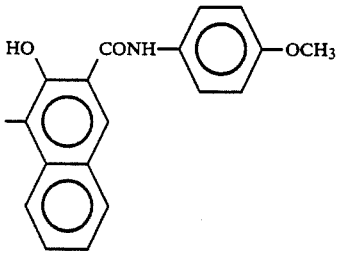 |
| 24 | 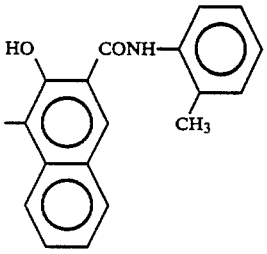 |
| 25 | 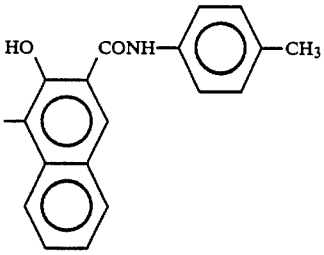 |
| 26 | 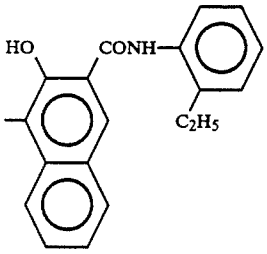 |
| 27 | 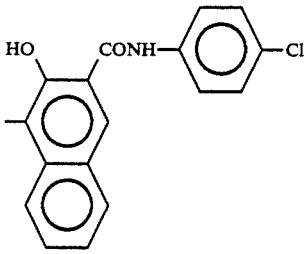 |
| 28 | 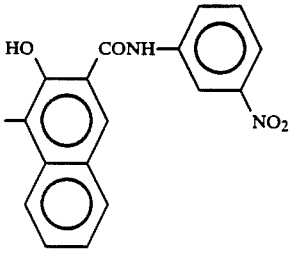 |

-continued
| Pigment No. | A |
|---|---|
| 29 | 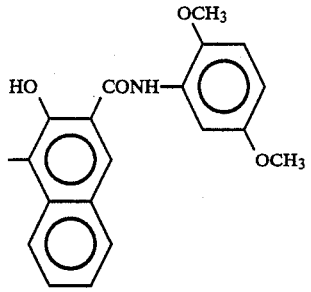 |
| 30 | 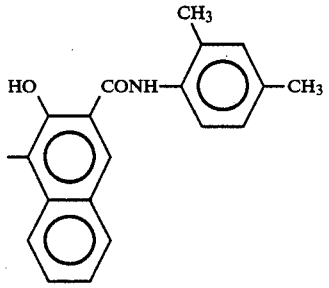 |
| 31 | 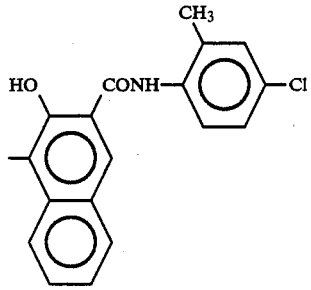 |
| 32 | 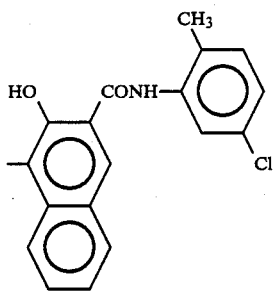 |
| 33 | 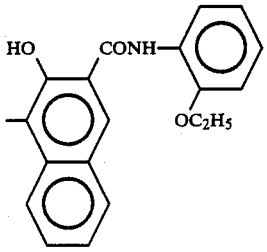 |

-continued
| Pigment No. | A |
|---|---|
| 34 | 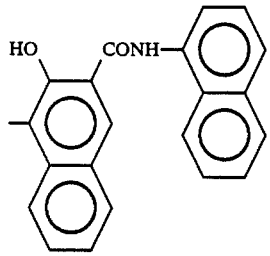 |
| 35 | 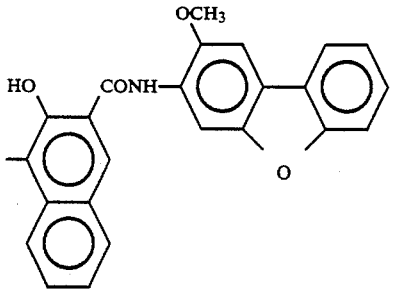 |
| 36 | 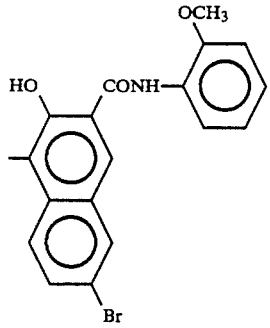 |
| 37 | 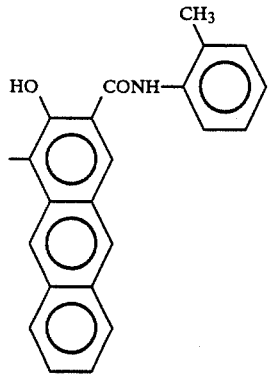 |
| 38 | 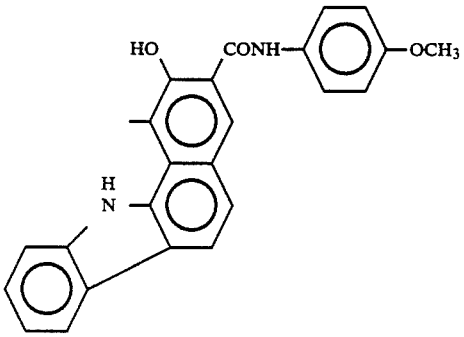 |

-continued
| Pigment No. | A |
|---|---|
| 39 | 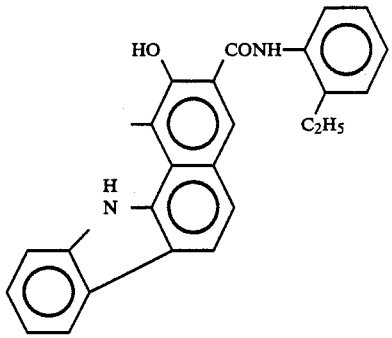 |
| 40 | 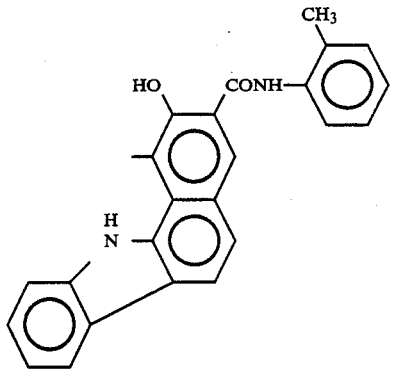 |
| 41 | 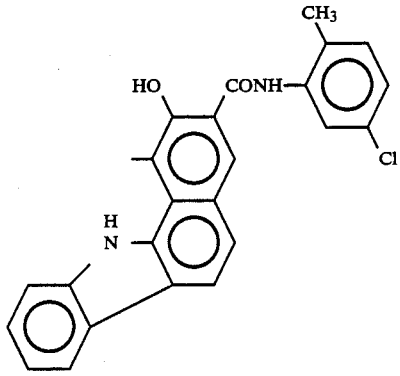 |
| 42 | 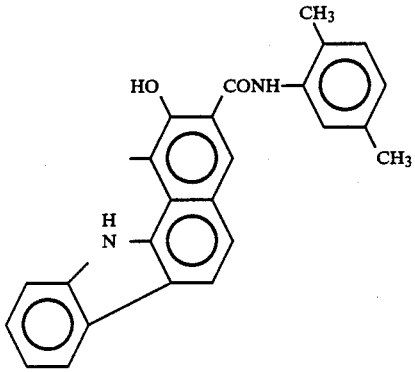 |

-continued
| Pigment No. | A |
|---|---|
| 43 | 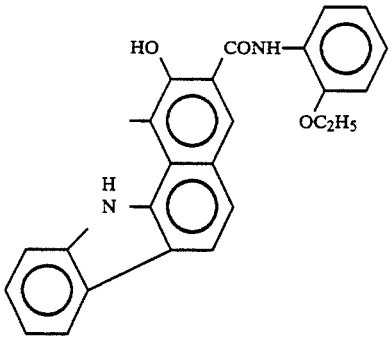 |
| 44 | 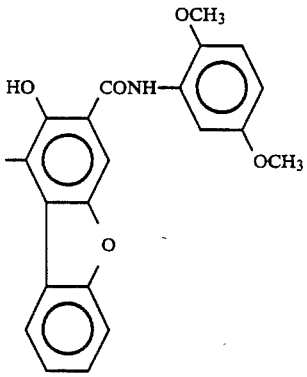 |
| 45 | 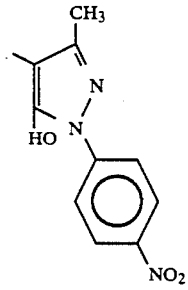 |
| 46 | 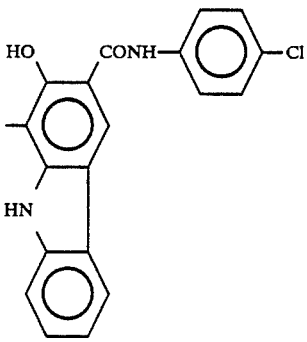 |

-continued
| Pigment No. | A |
|---|---|
| 47 | 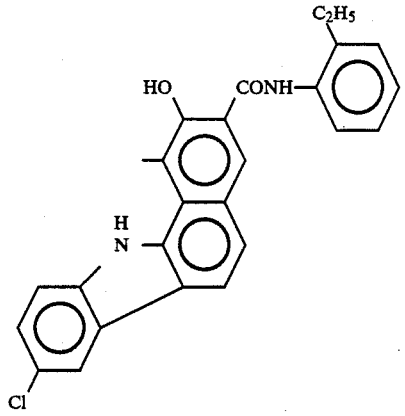 |
| 48 | 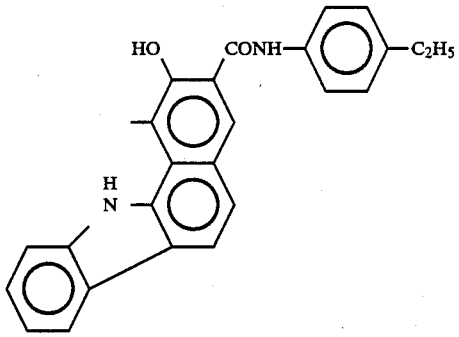 |
| | 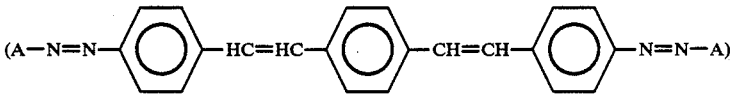 |
| 49 | 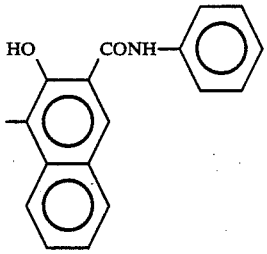 |
| 50 | 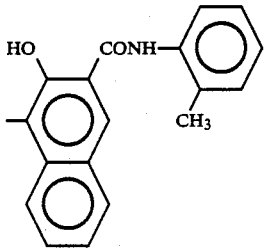 |

-continued
| Pigment No. | A |
|---|---|
| 51 | 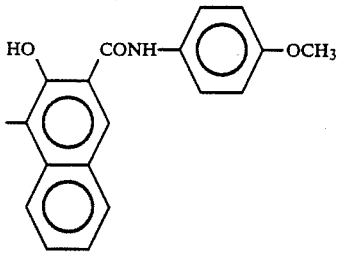 |
| 52 | 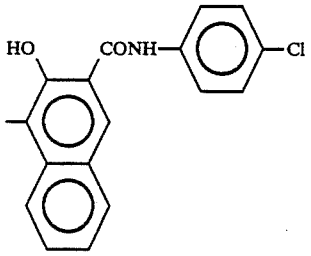 |
| 53 | 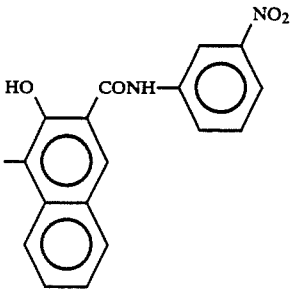 |
| 54 | 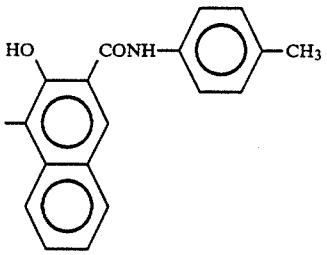 |
| 55 | 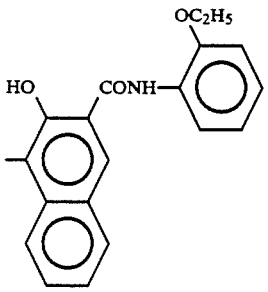 |

-continued
| Pigment No. | A |
|---|---|
| 56 | 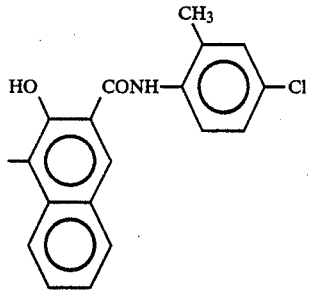 |
| 57 | 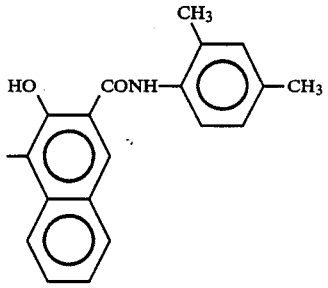 |
| 58 | 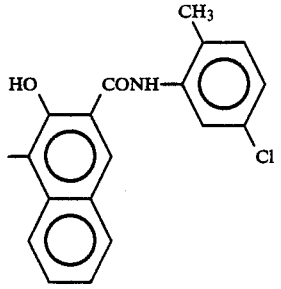 |
| 59 | 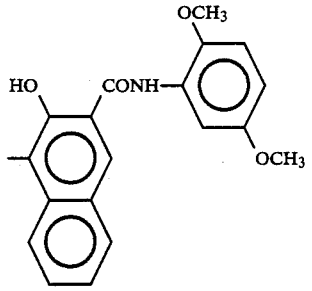 |
| 60 | 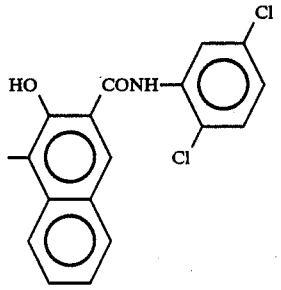 |

-continued
| Pigment No. | A |
|---|---|
| 61 | 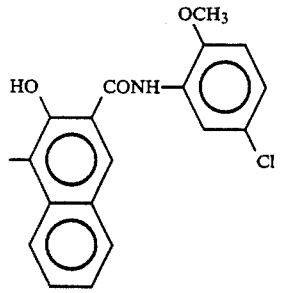 |
| 62 | 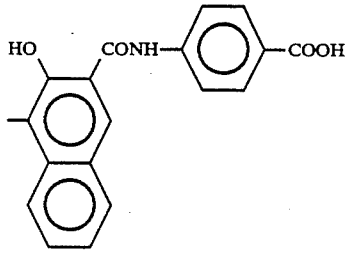 |
| 63 | 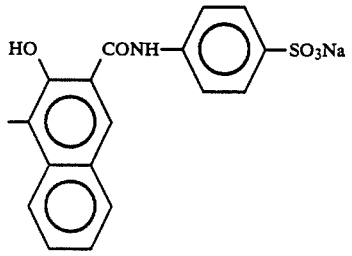 |
| 64 | 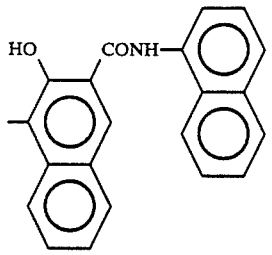 |
| 65 | 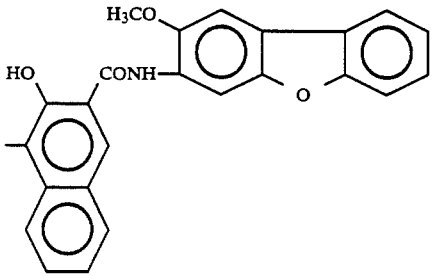 |

-continued
| Pigment No. | A |
|---|---|
| 66 | 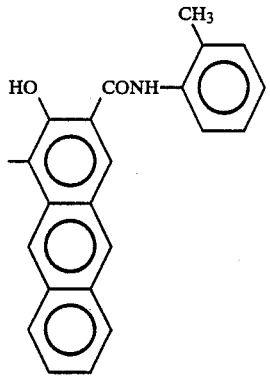 |
| 67 | 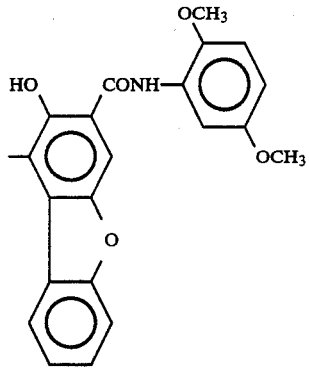 |
| 68 | 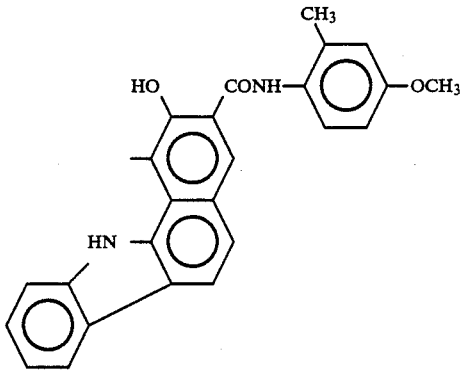 |
| 69 | 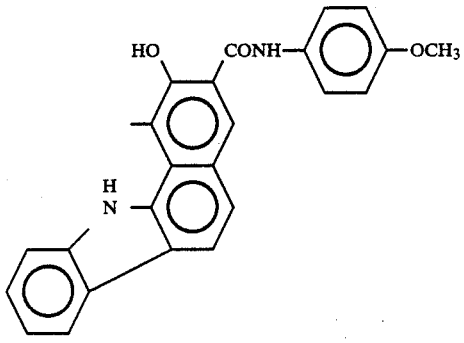 |

-continued

| Pigment No. | A |
|---|---|
| 70 | 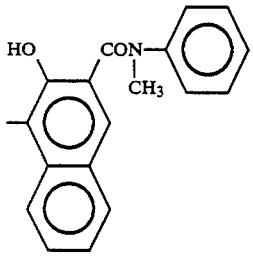 |
| 71 | 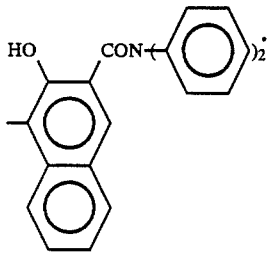 |
| 72 | 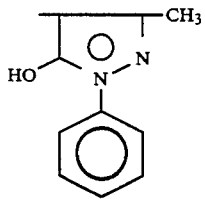 |
| 73 | 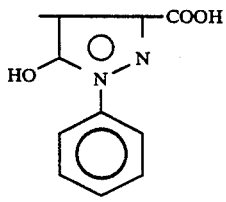 |
| 74 | 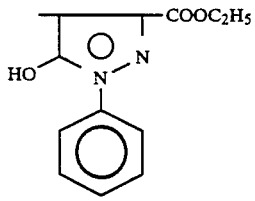 |

The above charge-generating materials can be used alone or in combination.

It is preferable that the amount of the binder resin in the charge-generating layer be 0 to 100 parts by weight, more preferably 0 to 50 parts by weight, to 100 parts by weight of the charge-generating material.

The charge-generating layer may be formed in the following manner. Namely, a charge-generating material is dispersed, if necessary with a binder resin, in a solvent such as tetrahydrofurane, cyclohexanone, dioxane, and dichloroethane by using a ball mill, an attritor or a sandmill, followed by dilution with the same solvent. The resulting dispersion is applied to the surface of the electroconductive support in accordance with an application method such as dip coating, spray coating, and bead coating.

It is preferable that the thickness of the charge-generating layer be in the range of from about 0.01 μm to about 5 μm, more preferably in the range of 0.1 μm to 2 μm.

The charge-transport layer in the present invention comprises a charge-transport material as the main component, and may further comprise a binder resin, if necessary.

In general, the charge-transport materials can be classified into two types, that is, a positive hole-transport material and an electron-transport material.

Positive hole-transport materials are electron-donor-type materials such as poly-N-vinylcarbazole and derivatives thereof; poly-γ-carbazolyl ethylglutamate and derivatives condensation products of pyrene and formaldehyde, and derivatived thereof; polyvinylpyrene; polyvinylphenanthrene; oxazole derivatives; oxadiazole derivatives; imidazole derivatives; triphenylamine derivatives; 9-(p-diethylaminostyryl)anthracene; 1,1-bis- (4-dibenzylaminophenyl)propane; styrylanthracene; styrylpyrazoline; phenylhydrazones; and α-phenylstrylbene derivatives.

Electron-transport materials are electron-acceptor-type materials such as chloranil, bromanil, tetracyanoethylene, tetracyanoquinone dimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-4H-indeno-[1,2-b]thiophene-4-on, 1,3,7-trinitrodibenzothiophenone-5,5-dioxanoid.

The above charge-transport materials are used alone or in combination.

Examples of binder resins co-usable with the charge-transport materials include thermoplastic and thermosetting resins such as polystyrene, styrene-acrylonitrile copolymers, styrene-butadiene copolymers, styrene-maleic anhydride copolymers, polyester, polyvinylchloride, vinyl chloride—vinyl acetate copolymers, polyvinyl-acetate, polyvinylidene chloride, polyacrylate resin, phenoxy resin, polycarbonate, cellulose acetate resin, ethylcellulose resin, polyvinylbutyral, polyvinylformal, polyvinyl ketone, poly-N-vinylcarbazole, acrylic resin, silicone resin, epoxy resin, melanine resin, urethane resin, phenol resin, and alkyd resin.

The above-described compounds are dissolved or dispersed in a suitable solvent such as tetrahydrofurane, dioxane, toluene, monochlorobenzene, dichloroethane, and methylene chloride. The resulting solution or dispersion is applied to the surface of the charge-generating layer, and then dried to form a charge-transport layer.

It is preferable that the thickness of the charge-transport layer be in the range of about 5 μm to about 100 μm. In addition to the above compounds, auxiliary additives such as plasticizers and leveling agents can be incorporated into the charge-transport layer.

As such plasticizers, plasticizers for use in ordinary resins, such as dibutylphthalate and dioctylphthalate, can be added to the charge-transport layer as they are. It is preferable that the amount of such plasticizers be in the range of 0 to about 30 wt. % of the binder resin.

As the leveling agent, silicone oils such as dimethyl sllicone oil and methylphenyl silicone oil are usable. It is preferable that the amount of such leveling agents be in the range of 0 to 1 wt. % of the binder resin.

The electrophotographic photoconductor of the present invention may be structured in such a fashion that on an electroconductive support, an undercoat layer, a charge-generating layer, and a charge-transport layer are superposed in this order. The charge-generating layer and the charge-transport layer may be superposed in the reverse order to the above.

On the surface of the photosensitive layer, a protective layer or an overcoat layer can be formed in order to protect the photosensitive layer from mechanical abrasion or ozone exposure at the time of charging. Further, in order to improve the adhesion between the electroconductive support and the undercoat layer, an adhesive layer may be interposed between these two layers.

The features of this invention will become apparent in the course of the following description of exemplary embodiments, which are given for illustration of the invention and are not intended to be limiting thereof.

EXAMPLE 1

Preparation of Undercoat Layer Coating Liquid 8.7 g of finely-divided particles of indium oxide of 99.99% purity and 61 g of a cyclohexanone solution containing 4 wt. % of a butyral resin (Trademark "S-LEC BL-1", made by Sekisui Chemical, Co., Ltd.) were placed in a pot made of hard glass of 9 cm in dia. half filled with YTZ (partially stabilized zirconia) balls of 1 cm in dia., and milled for 5 days. Thereafter, 9.5 g of a methyl ethyl ketone solution containing 8 wt. % of tolylene diisocyanate was added to the above mixture, and the mixture was shaken for about 5 min., preparing thereby an undercoat layer coating liquid.

The thus prepared undercoat layer coating liquid was coated on an aliminum drum of 80 mm in dia. by the spraying coating method, and hardened by drying the same at 130° C. for one hour, thereby forming an undercoat layer having a thickness of about 3 μm.

Preparation of Charge-Generating Layer Coating Liquid 300 g of cyclohexanone, and 6 g of the aforementioned Azo Pigment No. 1 were placed in a pot made of hard glass of 15 cm in dia. half filled with YTZ balls of 1 cm in dia., and milled for 120 hours. Thereafter, 500 g of methyl ethyl ketone was added to the above mixture, and milling was continued for a further 24 hours, preparing thereby a charge-generating layer coating liquid.

The thus prepared charge-generating layer coating liquid was coated on the surface of the above-formed undercoat layer by the dip coating method, followed by drying the same at 120° C. for 20 min., whereby a charge-generating layer having a thickness of about 0.1 μm was formed.

Preparation of Charge-Transport Layer Coating Liquid

A mixture of the following components was dispersed in a ball mill, whereby a charge-transport layer coating liquid was prepared.

| | Parts by Weight |
|---|---|
| 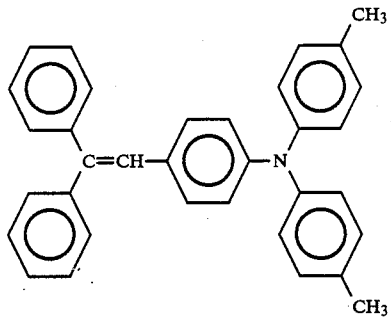 | 100 |
| Polycarbonate (Trademark "PANLITE C-1400", made by Teijin Limited) | 100 |
| Silicone Oil (Trademark "KF-50", made by Shin-Etsu Chemical Co., Ltd.) | 0.3 |
| Tetrahydrofurane | 800 |

The above prepared charge-transport layer coating liquid was coated on the charge-generating layer by the dip coating method, and dried the same at 120 °C. for 30 min., whereby a charge-transport layer having a thickness of about 20 μm was formed on the charge-generating layer. Thus an electrophotographic photoconductor No. 1 according to the present invention was prepared.

EXAMPLE 2

Example 1 was repeated except that 8.7 g of finely-divided particles of indium oxide in the undercoat layer coating liquid employed in Example 1 was replaced with 14.5 of the same, whereby an electro-photographic photoconductor No. 2 according to the present invention was prepared.

EXAMPLE 3

Example 1 was repeated except that 8.7 g of finely-divided particles of indium oxide in the undercoat layer coating liquid employed in Example 1 was replaced with 23.2 g of the same, whereby an electrophotographic photoconductor No. 3 according to the present invention was prepared.

EXAMPLE 4

Example 1 was repeated except that 8.7 g of finely-divided particles of indium oxide, and the butyral resin in the undercoat layer coating liquid employed in Example 1 were respectively replaced with 14.5 g of finely-divided particles of indium oxide, and a styrene-methyl methacrylate-hydroxyethyl methacrylate copolymer (with the respective molar ratio of 8:5:7), whereby an electrophotographic photoconductor No. 4 according to the present invention was prepared.

EXAMPLE 5

Preparation of Undercoat Layer Coating Liquid 14.5 g of finely-divided particles of indium oxide of 99.99% purity and 61 g of a cyclohexanone solution containing 4 wt. % of a styrene-methyl methacrylate-hydroxyethyl methacrylate copolymer with a molar ratio of 10:3:7 were placed in a pot made of hard glass of 9 cm in dia. half filled with YTZ (partially stabilized zirconia) balls of 1 cm in dia., and milled for 5 days. Thereafter, 9.5 g of a methyl ethyl ketone solution containing 8 wt. % of hexamethylene diisocyanate was added to the above mixture, and the mixture was shaken for about 5 min., preparing thereby an undercoat layer coating liquid.

The thus prepared undercoat layer coating liquid was coated on an aliminum drum of 80 mm in dia. by the spray coating method, and hardened by drying the same at 130° C. for one hour, thereby forming an undercoat layer having a thickness of about 3 μm.

Preparation of Charge-Generating Layer Coating Liquid 300 g of cyclohexanone, and 6 g of the aforementioned Azo Pigment No. 1 were placed in a pot made of hard glass of 15 cm in dia. half filled with YTZ balls of 1 cm in dia., and milled for 120 hours. Thereafter, 500 g of methyl ethyl ketone was added to the above mixture, and milling was continued for a further 24 hours, preparing thereby a charge-generating layer coating liquid.

The thus prepared charge-generating layer coating liquid was coated on the surface of the above-formed undercoat layer by the dip coating method, followed by drying the same at 120° C. for 20 min., whereby a charge-generating layer having a thickness of about 0.1 μm was formed.

Preparation of Charge-Transport Layer Coating Liquid

A mixture of the following components was dispersed in a ball mill, whereby a charge-transport layer coating liquid was prepared.

| | Parts by Weight |
|---|---|
| 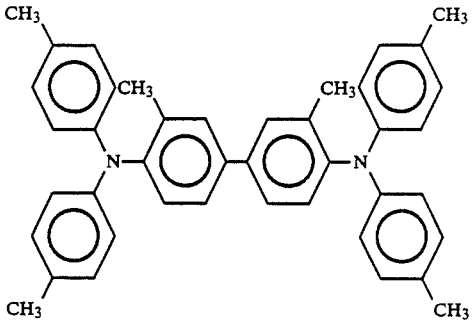 | 80 |
| Polycarbonate (Trademark "PANLITE C-1400", made by Teijin Limited) | 100 |
| Silicone Oil (Trademark "KF-50", made by Shin-Etsu Chemical Co., Ltd.) | 0.3 |
| Methylene chloride | 800 |

The above prepared charge-transport layer coating liquid was coated on the charge-generating layer by the dip coating method, and dried the same at 120° C. for 30 min., whereby a charge-transport layer having a thickness of about 20 μm was formed on the charge-generating layer. Thus an electrophotographic photoconductor No. 5 according to the present invention was prepared.

EXAMPLE 6

Preparation of Undercoat Layer Coating Liquid 8.7 g of finely-divided particles of indium oxide of 99.99% purity and 61 g of a cyclohexanone solution containing 4 wt. % of butyral resin (Trademark "S-LEC BL-1", made by Sekisui Chemical, Co., Ltd;) were placed in a pot made of hard glass of 9 cm in dia., half filled with YTZ (partially stabilized zirconia) balls of 1 cm in dia., and milled for 5 days. Thereafter, 9.5 g of a methyl ethyl ketone solution containing 4 wt. % of tolylene diisocyanate was added to the above mixture, and the mixture was shaken for about 5 min., preparing thereby an undercoat layer coating liquid.

The thus prepared undercoat layer coating liquid was coated on an aliminum drum of 80 mm in dia., by the spray coating method, and hardened by drying the same at 130° C. for one hour, thereby forming an undercoat layer having a thickness of about 3 μm.

Preparation of Charge-Generating Layer Coating Liquid 300 g of a cyclohexanone solution containing 2.7 wt. % of a butyral resin (Trademark "XYHL"), and 16 g of the aforementioned Azo Pigment No. 7 were placed in a pot made of hard glass of 15 cm in dia. half filled with YTZ balls of 1 cm in dia., and milled for 72 hours. Thereafter, 500 g of methyl ethyl ketone was added to the above mixture, and milling was continued for a further 24 hours, preparing thereby a charge-generating layer coating liquid.

The thus prepared charge-generating layer coating liquid was coated on the above-formed undercoat layer by the dip coating method, followed by drying the same at 120° C. for 20 min., whereby a charge-generating layer having a thickness of about 0.1 μm was formed.

Preparation of Charge-Transport Layer Coating Liquid

A mixture of the following components was dispersed in a ball mill, whereby a charge-transport layer coating liquid was prepared.

| | Parts by Weight |
|---|---|
| 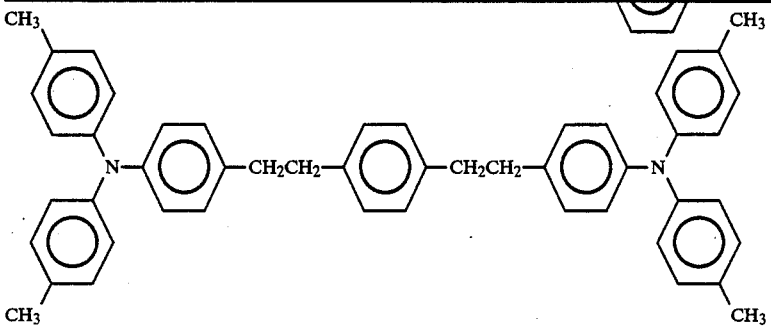 | 70 |
| Polystyrene (Trademark "HRM700") | 100 |
| Silicone Oil (Trademark "KF-50", made by Shin-Etsu Chemical Co., Ltd.) | 0.3 |
| Tetrahydrofurane | 400 |

The above prepared charge-transport layer coating liquid was coated on the charge-generating layer by the dip coating method, and dried the same at 120° C. for 30 min., whereby a charge-transport layer having a thickness of about 20 μm was formed on the charge-generating layer, whereby an electrophotographic photoconductor No. 6 according to the present invention was prepared.

EXAMPLE 7

The same undercoat layer having a thickness of about 3 μm as that formed in Example 1 was formed on an Al drum having a dia. of 80 mm in the same manner as in Example 1. Thereafter, the same charge-generating layer as that formed in Example 6 was formed on the above undercoat layer in the same manner as in Example 6.

Preparation of Charge-Transport Layer coating Liquid

A mixture of the following components was dispersed in a ball mill, whereby a charge-transport layer coating liquid was prepared.

| | Parts by Weight |
|---|---|
| 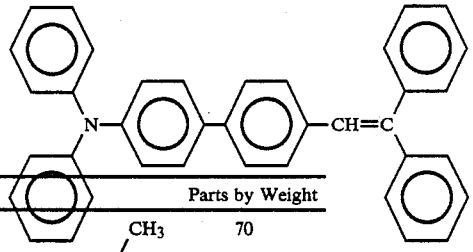 | 100 |
| Polycarbonate (Trademark "PANLITE C-1400") | 100 |
| Silicone Oil (Trademark "KF-50", made by Shin-Etsu Chemical Co., Ltd.) | 0.3 |
| Methylene chloride | 800 |

The above prepared charge-transport layer coating liquid was coated on the charge-generating layer by the dip coating method, and dried the same at 120° C. for 30 min., whereby a charge-transport layer having a thickness of about 20 μm was formed on the charge-generating layer. Thus an electrophotographic photoconductor No. 7 according to the present invention was prepared.

EXAMPLE 8

Example 7 was repeated except that the Azo Pigment No. 7 employed in the charge-generating layer coating liquid in Example 7 was replaced by the aforementioned Azo Pigment No. 57, whereby an electrophotographic photoconductor according to the present invention No. 8 was prepared.

EXAMPLE 9

Example 2 was repeated except that the charge-generating layer coating liquid employed in Example 2 was replaced by a charge-generating layer coating liquid prepared as follows and the thickness of the charge-generating layer was changed to about 0.2 μm, whereby an electrophotographic photoconductor No. 9 according to the present invention was prepared.

Preparation of Charge-Generating Layer Coating Liquid 300 g of a cyclohexanone solution containing 2.7 wt. % of a polyester resin (Trademark "Vylon 200"), and 20 g of the aforementioned Azo Pigment No. 39 were placed in a pot made of hard glass of 15 cm in dia. half filled with YTZ balls of 1 cm in dia., and milled for 120 hours. Thereafter, 500 g of methyl ethyl ketone was added to the above mixture, and milling was continued for a further 24 hours, preparing thereby a charge-generating layer coating liquid.

EXAMPLE 10

The same undercoat layer having a thickness of about 3 μm as that employed in Example 2 was formed on an Al drum having a dia. of 80 mm in the same manner as in Example 2. Thereafter, the same charge-transport layer coating liquid as that employed in Example 6 was coated on the above undercoat layer by the dip coating method, and dried at 120° C. for 30 min., whereby a charge-transport layer having a thickness of about 20 μm was formed.

The same charge-generating layer coating liquid as that employed in Example 1 was coated on the above charge-generating layer by the spray coating method, and dried at 120° C. for 40 min. to form a charge-generating layer having a thickness of about 0.1 μm on the charge-transport layer.

The thus formed charge-generating layer was coated with an overcoat layer coating liquid of the following formulation by the spray coating method, and dried with application of heat thereto at 120° C. for 30 min. to form an overcoat layer having a thickness of about 0.3 μm on the charge-generating layer, whereby an electrophotographic photoconductor No. 10 according to the present invention was prepared.

Formulation of Coating Liquid

| | Parts by Weight |
|---|---|
| Alcohol-soluble Nylon (Trademark "CM-8000", made by Toray Industries, Inc.) | 3 |
| Methanol | 40 |
| Butanol | 57 |

COMPARATIVE EXAMPLE 1

Example 1 was repeated except that 8.7 g of finely-divided particles of indium oxide employed in the undercoat layer coating liquid in Example 1 was replaced by 1.45 g of the same, whereby a comparative electrophotographic photoconductor No. 1 was prepared.

COMPARATIVE EXAMPLE 2

Example 1 was repeated except that 8.7 g of finely-divided particles of indium oxide employed in the undercoat layer in Example 1 was replaced by 5.8 g of the same, whereby a comparative electrophotographic photoconductor No. 2 was prepared.

COMPARATIVE EXAMPLE 3

Example 1 was repeated except that 8.7 g of finely-divided particles of indium oxide employed in the undercoat layer in Example 1 was replaced by 55.1 g of the same, whereby a comparative electrophotographic photoconductor No. 3 was prepared.

COMPARATIVE EXAMPLE 4

Example 1 was repeated except that the undercoat layer coating liquid employed in Example 1 was replaced by a comparative undercoat layer coating liquid A prepared as follows, whereby a comparative electrophotographic photoconductor No. 4 was prepared.

Preparation of Comparative Undercoat Layer Coating Liquid A 14.5 g of finely-divided particles of indium oxide of 99.99% purity and 72 g of a cyclohexanone solution containing 4 wt. % of a butyral resin (Trademark "S-LEC BL-1", made by Sekisui Chemical, Co., Ltd.) were placed in a pot made of hard glass of 9 cm in dia. half filled with YTZ (partially stabilized zirconia) balls of 1 cm in dia., and milled for 5 days, preparing thereby a comparative undercoat layer coating liquid A.

COMPARATIVE EXAMPLE 5

Example 4 was repeated except that the undercoat layer coating liquid employed in Example 4 was replaced by a comparative undercoat layer coating liquid B prepared as follows, whereby a comparative electrophotographic photoconductor No. 5 was prepared.

Preparation of Comparative Undercoat Layer Coating Liquid B 14.5 g of finely-divided particles of indium oxide of 99.99% purity and 72 g of a cyclohexanone solution containing 4 wt. % of a styrene—methyl methacrylate hydroxyethyl methacrylate copolymer with a molar ratio of 10:3:7 were placed in a pot made of hard glass of 9 cm in dia. half filled with YTZ (partially stabilized zirconia) balls of 1 cm in dia., and milled for 5 days, preparing thereby a comparative undercoat layer coating liquid B.

COMPARATIVE EXAMPLE 6

Example 1 was repeated except that the undercoat layer coating liquid employed in Example 1 was replaced by an undercoat layer coating liquid prepared as follows, whereby a comparative electrophotographic photoconductor No. 6 was prepared.

Preparation of Comparative Undercoat Layer Coating Liquid C 14.5 g of finely-divided particles of indium oxide of 99.99% purity and 61 g of a cyclohexanone solution containing 4 wt. % of butyral resin (Trademark "S-LEC BL-1", made by Sekisui Chemical, Co., Ltd.) were placed in a pot made of hard glass of 9 cm in dia. half filled with YTZ (partially stabilized zirconia) balls of 1 cm in dia., and milled for 5 days. Thereafter, 1.3 g of a butyrol melamine solution (Trademark "SUPER BECKAMINE G-821-60", made by Dainippon Ink & Chemicals, Inc.) and 8.2 g of methyl ethyl ketone were added to the above mixture, and the mixture was shaken for about 5 min., preparing thereby a comparative undercoat layer coating liquid C.

COMPARATIVE EXAMPLE 7

Example 1 was repeated except that the undercoat layer coating liquid employed in Example 1 was replaced by a comparative undercoat layer coating liquid D prepared as follows, whereby a comparative electrophotographic photoconductor No. 7 was prepared.

Preparation of Comparative Undercoat Layer Coating Liquid D 14.5 g of finely-divided particles of indium oxide of 99.99% purity, 3.8 g of an alkyd resin solution (Trademark "BECKOLITE M-640-50", made by Dainippon Ink & Chemicals, Inc.), 2.2 g of a butyrol melamine solution (Trademark "SUPER BECKAMINE G-821-60"), 45 g of cylcohexanone, and 19.5 g of methyl ethyl ketone were placed in a pot made of hard glass of 9 cm in dia. half filled with YTZ (partially stabilized zirconia) balls of 1 cm in dia., and milled for 5 days, preparing thereby a comparative undercoat layer coating liquid D.

COMPARATIVE EXAMPLE 8

Example 1 was repeated except that 8.7 g of finely-divided particles of indium oxide employed in the undercoat layer coating liquid in Example 1 was replaced by 14.5 of finely-divided particles of tin oxide containing 10 wt. % of antimony oxide, whereby a comparative electrophotographic photoconductor No. 8 was prepared.

COMPARATIVE EXAMPLE 9

Example 1 was repeated except that 8.7 g of finely-divided particles of indium oxide employed in the undercoat layer coating liquid in Example 1 was replaced by 8.7 g of carbon powder (Trademark "BLACK PEARL #2000", made by Cabot Corporation), whereby a comparative electrophotographic photoconductor No. 9 was prepared.

COMPARATIVE EXAMPLE 10

Example 1 was repeated except that 8.7 g of finely-divided particles of indium oxide employed in the undercoat layer coating liquid in Example 1 was replaced by 14.5 g of finely-divided particles of rutile titanium oxide (Trademark "TIPAQUE R-680", made by Ishihara Sangyo Kaisha, Ltd.), whereby a comparative electrophotographic photoconductor No. 10 was prepared.

COMPARATIVE EXAMPLE 11

Example 1 was repeated except that the undercoat layer coating liquid employed in Example 1 was replaced by a comparative undercoating layer coating liquid E with the following formulation, whereby a comparative electrophotographic photoconductor No. 11 was prepared.

Formultaion of Comparative Undercoat Layer Coating Liquid E

| | Parts by Weight |
|---|---|
| Alcohol-soluble nylon (Trademark "CM-8000") | 3 |
| Methanol | 57 |
| Butanol | 40 |

COMPARATIVE EXAMPLE 12

Example 1 was repeated except that the undercoat layer formed in Example 1 was eliminated, whereby a comparative electrophotographic photoconductor No. 12 was prepared. By using a photoconductor electric potential simulator as described in Japanese Laid-open Patent Application No. 60-00167, changes in the chargeablity ($V_D$), sensitivity ($V_L$), and residual potential (VR) after repeated use of the above-prepared electrophotographic photoconductors of the present invention and comparative electrophotographic photoconductors were evaluated under the following evaluation conditions:

Conditions for Evaluation $V_D$: Surface potential after charging
Rotational Speed of Drum: 80 rpm
Charging Condition: −7.5 kV
$V_L$: Surface potential after exposure
Exposing illuminance: 30 lux
Width of Exposure Slit: 10 mm
$V_R$: Potential after quenching
Exposing illuminance: 350 lux
Width of Exposure Slit: 10 mm
$V'_D$, $V'_L$, $V'_R$: Potential after repeated use for 1 hour The results are shown in the table below.

| | Undercoat Layer | | | Initial Properties | | | Properties after Repeated Use | | |
|---|---|---|---|---|---|---|---|---|---|
| | Filler (F) | Resin (R) | F/R wt. % | $V_D$ | $V_L$ | $V_R$ | $V'_D$ | $V'_L$ | $V'_R$ |
| Example 1 | $In_2O_3$ | B-I | 3/1 | −880 | −130 | −20 | −810 | −135 | −25 |
| Example 2 | " | " | 5/1 | −855 | −120 | −10 | −820 | −120 | −10 |
| Example 3 | " | " | 8/1 | −860 | −125 | −5 | −835 | −120 | −10 |
| Example 4 | " | H-I | 5/1 | −885 | −130 | −15 | −850 | −125 | −20 |
| Example 5 | " | " | " | −850 | −125 | −10 | −800 | −115 | −10 |
| Example 6 | " | B-I | " | −865 | −110 | −5 | −815 | −105 | −5 |
| Example 7 | " | " | " | −880 | −120 | −10 | −860 | −130 | −20 |
| Example 8 | " | " | " | −855 | −135 | −15 | −780 | −115 | −20 |
| Example 9 | " | " | " | −850 | −105 | −15 | −795 | −90 | −25 |
| Example 10* | " | " | " | +845 | +130 | +20 | +790 | +120 | +30 |
| Comparative Example 1 | $In_2O_3$ | B-I | ½ | −890 | −255 | −100 | −690 | −240 | −105 |
| Comparative Example 2 | " | " | 2/1 | −870 | −180 | −55 | −715 | −170 | −60 |
| Comparative Example 3 | " | " | 95/2 | −840 | −200 | −5 | −810 | −210 | −10 |
| Comparative Example 4 | " | B | 5/1 | −885 | −400 | −210 | −895 | −580 | −275 |
| Comparative Example 5 | " | H | " | −900 | −305 | −170 | −880 | −535 | −240 |
| Comparative Example 6 | " | B-M | " | −865 | −220 | −15 | −840 | −265 | −75 |

-continued

| | Undercoat Layer | | | Initial Properties | | | Properties after Repeated Use | | |
|---|---|---|---|---|---|---|---|---|---|
| | Filler (F) | Resin (R) | F/R wt. % | $V_D$ | $V_L$ | $V_R$ | $V'_D$ | $V'_L$ | $V'_R$ |
| Comparative Example 7 | " | A-M | " | −875 | −135 | −5 | −860 | −190 | −65 |
| Comparative Example 8 | $SnO_2$ | B-I | " | −850 | −120 | −5 | −680 | −105 | −10 |
| Comparative Example 9 | C | " | 3/1 | −615 | −140 | −20 | −335 | −60 | −10 |
| Comparative Example 10 | $TiO_2$ | " | 5/1 | −820 | −125 | −10 | −665 | −100 | −25 |
| Comparative Example 11 | — | N | 0/1 | −865 | −145 | −20 | −700 | −195 | −65 |
| Comparative Example 12 | — | — | — | −750 | −95 | −5 | −580 | −70 | −5 |

*Evaluated with application of +9.0 kV for charging.
B-I: Butyral resin - Tolylenediisocyanate
H-I: Styrene/methyl methacrycrylate/hydroxyethyl methacrylate - Tolylenediisocyanate
B: Butyral resin
H: Styrene/methyl methacrylate/hydroxyethyl methacrylate
M: Buthylol Melamine
N: Nylon

What is claimed is:

1. An electrophotographic photoconductor comprising an electroconductive support;

an undercoat layer formed on said electroconductive support, comprising (i) a reaction product between an active-hydrogen-containing compound having a plurality of active hydrogens and an isocyanate-group-containing compound, which reaction product serves as a binder resin, and (ii) finely-divided particles of indium oxide dispersed in said reaction product; and a photosensitive layer formed on said undercoat layer.

2. The electrophotographic photoconductor as claimed in claim 1, wherein said undercoat layer further comprises a metal oxide in an amount of 50 wt. % or less of the total of said indium oxide and said metal oxide.

3. The electrophotographic photoconductor as claimed in claim 1, wherein said undercoat layer further comprises a metal fluoride in an amount of 50 wt. % or less of the total of said indium oxide and said metal fluoride.

4. The electrophotographic photoconductor as claimed in claim 1, wherein said undercoat layer further comprises a metal nitride in an amount of 50 wt. % or less of the total of said indium oxide and said metal nitride.

5. The electrophotographic photoconductor as claimed in claim 1, wherein said undercoat layer further comprises a metal carbide in an amount of 50 wt. % or less of the total of said indium oxide and said metal carbide.

6. The electrophotographic photoconductor as claimed in claim 1, wherein said undercoat layer further comprises a metal boride in an amount of 50 wt. % or less of the total of said indium oxide and said metal boride.

7. The electrophotographic photoconductor as claimed in claim 2, wherein said metal oxide is selected from the group consisting of titanium oxide, aluminum oxide, calcium oxide, magnesium oxide, tin oxide, zirconium oxide, silicone oxide, beryllium oxide, zinc oxide, and yttrium oxide.

8. The electrophotographic photoconductor as claimed in claim 3, wherein said metal fluoride is selected from the group consisting of magnesium fluoride, calcium fluoride, and aluminum fluoride.

9. The electrophotographic photoconductor as claimed in claim 4, wherein said metal nitride is selected from the group consisting of boron nitride, aluminum nitride, and silicon nitride.

10. The electrophotographic photoconductor as claimed in claim 5, wherein said metal carbide is selected from the group consisting of boron carbide, and silicon carbide.

11. The electrophotographic photoconductor as claimed in claim 6, wherein said metal boride is selected from the group consisting of calcium boride, and silicon boride.

12. The electrophotographic photoconductor as claimed in claim 1, wherein said active-hydrogen-containing compound comprises a plurality of active hydrogens of a group selected from the group consisting of a —OH group, an —$NH_2$ group, an NH group, a —SH group, and a —COOH group.

13. The electrophotographic photoconductor as claimed in claim 1, wherein said active-hydrogen-containing compound having a plurality of active hydrogens is selected from the group consisting of polyvinyl acetal, phenoxy resin, polyamide, polyester, alkyd resin, polyalkylene glycol, acrylic copolymers containing hydroxyethylmethacrylate groups, and vinylacetate copolymers containing vinyl alcohol groups.

14. The electrophotographic photoconductor as claimed in claim 1, wherein said isocyanate-group-containing compound is a mono-isocyanate compound.

15. The electrophotographic photoconductor as claimed in claim 1, wherein said isocyanate-group-containing compound is a di-isocyanate compound.

16. The electrophotographic photoconductor as claimed in claim 1, wherein said isocyanate-group-containing compound is a tri-isocyanate compound.

17. The electrophotographic photoconductor as claimed in claim 1, wherein said isocyanate-group-containing compound is a multi-functional isocyanate compound.

18. The electrophotographic photoconductor as claimed in claim 14, wherein said mono-isocyanate compound is selected from the group consisting of methyl isocyanate, ethyl isocyanate, propyl isocyanate, butyl isocyanate, phenyl isocyanate, tolyl isocyanate, naphthyl isocyanate, nitrophenyl isocyanate, and vinyl isocyanate.

19. The electrophotographic photoconductor as claimed in claim 15, wherein said di-isocyanate compound is selected from the group consisting of tolylene diisocyanate, hexamethylene diisocyanate, o-tolyldiisocyanate, diphenylmethane diisocyanate, naphthylene diisocyanate, and a dimer of tolylene diisocyanate.

20. The electrophotographic photoconductor as claimed in claim 16, wherein said tri-isocyanate compound is selected from the group consisting of triphenylmethane triisocyanate, and tris-(p-phenylisocyanate)thiophosphate.

21. The electrophotographic photoconductor as claimed in claim 17, wherein said multi-functional isocyanate compound is a compound prepared by dehydration condensation between a plurality of diisocyanates and/or triisocyanates.

22. The electrophotographic photoconductor as claimed in claim 1, wherein the amount of said indium oxide is 70 wt. % or more of the total weight of said indium oxide and said reaction product serving as a binder resin.

23. The electrophotographic photoconductor as claimed in claim 22, wherein the amount of said indium oxide is 80 wt. % to 90 wt. % of the total weight of said indium oxide and said reaction product serving as a binder resin.

24. The electro-photographic photoconductor as claimed in claim 1, wherein said undercoat layer has a thickness in the range of 0.2 μm to 20 μm.

25. The electrophotographic photoconductor as claimed in claim 24, wherein said undercoat layer has a thickness in the range of 0.5 μm to 5 μm.

26. The electrophotographic photoconductor as claimed in claim 1, wherein said photosensitive layer comprises a charge-generating material and a charge-transport material.

27. The electrophotographic photoconductor as claimed in claim 1, wherein said photosensitive layer comprises (a) a charge-generating layer comprising a charge-generating material and (b) a charge-transport layer comprising a charge-transporting material.

* * * * *

UNITED STATES PATENT AND TRADEMARK OFFICE

CERTIFICATE OF CORRECTION

PATENT NO. : 4,946,766

DATED : AUGUST 7, 1990

INVENTOR(S) : Toshio FUKAGAI

It is certified that error appears in the above-identified patent and that said Letters Patent is hereby corrected as shown below:

In column 38, line 12; column 39, line 47; and column 40, line 53: "aliminum" should read -- aluminum--.

In column 46, line 9, "Formultaion" should read -- Formulation --.

Signed and Sealed this

Eleventh Day of February, 1992

*Attest:*

HARRY F. MANBECK, JR.

*Attesting Officer*

*Commissioner of Patents and Trademarks*